United States Patent [19]

Ward

[11] Patent Number: 4,570,834

[45] Date of Patent: Feb. 18, 1986

[54] APPARATUS FOR EXTRUDING A FILLET

[75] Inventor: David J. Ward, Uttoxeter, England

[73] Assignee: Evode Limited, Stafford, England

[21] Appl. No.: 533,585

[22] Filed: Sep. 19, 1983

[30] Foreign Application Priority Data

| | | | |
|---|---|---|---|
| Sep. 23, 1982 | [GB] | United Kingdom | 8227197 |
| Oct. 15, 1982 | [GB] | United Kingdom | 8229483 |
| May 5, 1983 | [GB] | United Kingdom | 8312330 |

[51] Int. Cl.[4] ..... B65D 35/38

[52] U.S. Cl. ..... 222/566; 222/575; 425/87; 401/266

[58] Field of Search ..... 222/566, 511, 575; 401/261, 265, 266; 425/87, 458; 15/104 S, 235.4, 235.5, 235.7

[56] References Cited

U.S. PATENT DOCUMENTS

| | | | |
|---|---|---|---|
| 721,168 | 2/1903 | Egert | 425/458 |
| 888,629 | 5/1908 | MacLaughlin | 425/458 |
| 1,126,253 | 1/1915 | Morris | 425/458 |
| 1,142,022 | 6/1915 | Chapell | 401/265 |
| 1,390,126 | 9/1921 | Halaska | 425/458 |
| 2,247,603 | 7/1941 | Christman | 425/458 |
| 2,818,602 | 1/1958 | Haretik et al. | 425/458 |
| 3,133,300 | 5/1964 | Freeman . | |
| 3,145,413 | 1/1963 | Alsleben | 401/266 |
| 3,594,089 | 7/1971 | Powell et al. . | |
| 3,627,435 | 12/1971 | Hendershot | 401/265 |

FOREIGN PATENT DOCUMENTS

| | | | |
|---|---|---|---|
| 27222 | of 1910 | United Kingdom . | |
| 800837 | 9/1958 | United Kingdom | 15/235.7 |

*Primary Examiner*—Joseph J. Rolla
*Assistant Examiner*—Louise S. Heim
*Attorney, Agent, or Firm*—Watson, Cole, Grindle & Watson

[57] ABSTRACT

An apparatus for applying pasty materials in the form of a fillet to a region between two surface parts includes an extrusion nozzle and a guide means at one end of the extrusion nozzle, the guide means including a fillet-forming portion which straddles the region and forms the fillet therein, and wiping portions which contact the surface parts adjacent to the region so as to prevent extruded pasty material from being deposited thereon.

7 Claims, 17 Drawing Figures

APPARATUS FOR EXTRUDING A FILLET

BACKGROUND TO THE INVENTION

There are occasions in various arts when it is desired to form a pasty material into a fillet between two surface parts, which may be parts of one surface, for example, regions bordering a crack in a surface, or parts of separate adjacent or meeting surfaces.

By a fillet is meant an elongated filling between surface parts which may be co-planar, parallel and spaced, or inclined at any angle and may meet or have spaced edges. The fillet may be between the edges of the surface parts or overlie a marginal region of one or both of them. The pasty materials used for producing such fillets are most frequently formulated to set into a solid or near-solid condition some time after application. Fillets commonly have a simple decorative function, but sometimes are required to provide a seal between surface parts and occasionally may have a mechanical function such as contributing to the retention of the surface parts in correct relationship.

One example is the provision of a sealing fillet between a wall of a room, such as a kitchen or bathroom, and a working surface or the surround of a sink, wash-basin or bath which abuts the wall, to prevent water from flowing between the sink, etc., and the wall, as well as to conceal and improve the appearance of the junction. Various manufacturers have produced sealing materials for this purpose in the form of pastes contained in collapsible tubes or cartridges from which the materials can be extruded. However, it is widely recognised that it is difficult for the user of such a tube or cartridge, particularly the home handyman or "do-it-yourself" enthusiast, who may be unskilled, to produce a fillet which both seals against the two surfaces and has a neat and attractive appearance.

A common practice when forming such fillets from pasty materials is to move the nozzle of the extrusion apparatus along the junction between the surfaces approximately in the opposite direction to the direction of flow of the pasty material through the nozzle orifice. The extruded material is simply laid in the junction whilst the nozzle is moved backwardly more or less at the same speed as the extruded fillet of pasty material emerges from the nozzle. The shape of the fillet is determined by the shape of the nozzle orifice and by the surfaces adjacent to the junction. However, it is difficult to maintain by hand the necessary relationship between the nozzle and the two surfaces and the uniform speeds of movement of the nozzle and extrusion of pasty material that are required to produce a fillet of constant cross section. Any lateral movement of the nozzle produces transverse ridges in the fillet. Moreover, by merely laying the fillet into the junction in this way, it is difficult to ensure complete contact of the fillet with both surfaces, as is necessary if a seal is the prime object. If the fillet does not adhere securely, it may subsequently be displaced.

An improved fillet, pressed against the surfaces and therefore adhering more securely, can be obtained by moving the nozzle forwardly, in the same direction as the extrusion of the material, whilst it is pressed against both surfaces adjacent to the junction. With a nozzle of the usual circular cross section, such a fillet has a concave outer surface defined in cross section by the outer edge of the nozzle. However, considerable skill is required in controlling the extrusion of the pasty material and moving the extrusion nozzle so as to maintain an adequate quantity of extruded material in advance of the nozzle to form the fillet, but not so much that material flows onto the surfaces outside the meeting points of the nozzle edge and the surfaces. The latter often happens when an unskilled person attempts to perform this operation, producing an unsightly result. Pasty material which has flowed onto the surfaces is difficult to remove later without disturbing the fillet. The invention enables such an improved fillet to be obtained more easily.

Often the pasty material for forming a fillet is applied from a mass of the material by hand or by use of hand held tools. One example is in the grouting of tiles, in which the usual method is to work the pasty grouting material into the gaps between the tiles with a sponge or cloth and then press it down into the gaps with a narrow tool. Grouting material left on the surfaces of the tiles then has to be removed, and this necessarily limits the kinds of materials that can be used for grouting, since any material having a tendency to adhere strongly to the tile surfaces is not readily removed. Consequently the materials commonly used for grouting do little more than fill the gaps between the tiles and do not contribute significantly to the overall strength of the tiled surface. Furthermore, the appearance of a grouted tiled surface depends to a considerable extent upon the skill of the person applying the grouting material, and is often unsatisfactory or even unsightly.

Another example of the application of pasty material by hand to form a fillet is in the glazing of windows. Conventionally, putty is worked by hand into the rebate of the window frame and against the margins of the glass, and is then pressed home and smoothed off at about 45° to the glass surface with a hand-held putty knife. Whilst a skilled glazier can perform this operation in a short time and produce a neat result, less-skilled operators such as "do-it-yourself" enthusiasts find it a slow and difficult task. Furthermore, because of the need to be able to remove any surplus putty from the glass and from parts of the window frame other than the rebate, it is not convenient to use putties which have strong adhesive characteristics. As a result, after a period of service, putty often separates from the glass and/or the window frame rebate, admitting water which promotes the growth of algae, rotting of the frame or, when frost occurs, may crack the glass or force the putty out of the rebate.

This invention concerns apparatus for extruding pasty materials to form fillets, applicable not only in circumstances in which extrusion is the method commonly used, but also in certain circumstances in which it is more usual to apply the pasty material from a mass by hand or hand-held tools.

Because of the restrictions which have been mentioned, and similar restrictions in other circumstances, various pasty materials which have properties which would be advantageous if they could be used to form fillets between surface parts have not hitherto been used except, perhaps, by skilled operators in particular circumstances. For example, the putties used for glazing usually have, as mentioned, little adhesion to glass or to window frame materials, but pasty materials are available which are capable of strong water-resisting adhesion to such surfaces. If a conventionally-glazed window is broken by an intending intruder, fragments of broken glass usually can be removed from the window frame without difficulty because they are not held by the putty. The present invention enables adhesive putties to be used which will hold fragments of glass in position after a window is broken and make intrusion into a building a good deal more difficult than when conventional putties are used.

Gaps between doors or casement windows and their outer frames have been filled to exclude draughts or for fire protection purposes by applying a pasty material to the frame with the door or window open and then closing the door or window and allowing the pasty material to set. By this method is difficult to ensure that gaps between the door or window and the frame, which are often of varying width, are completely filled. Where the gap is narrow, surplus material is squeezed out when the door or window is closed and has to be removed, but where the gap is wide the amount of material applied may be inadequate so that a seal is not achieved. The present invention enables sealing fillets to be produced with a door or window closed, with no wastage of material.

BRIEF SUMMARY OF THE INVENTION

According to this invention, apparatus for applying a pasty material to form a fillet in a region between two surface parts comprises guide means for use in association with an extrusion nozzle to be directed towards, positioned adjacent to and moved along the region whilst extruding pasty material therethrough, the guide means including a wiping portion for contacting one of the surface parts adjacent to the region and excluding extruded pasty material therefrom and a fillet forming portion for straddling the region to form extruded pasty material into the desired fillet.

The guide means preferably includes wiping portions for contacting both surface parts adjacent to the region. The wiping portions may make line or surface contact with the respective surface parts, according to their disposition. The surface parts may be edges of surfaces.

The guide means is preferably formed integrally with the extrusion nozzle, for example as an integral moulding in plastics material, but may be separately formed and mounted on the nozzle. For use with a collapsible tube or other extrusion device having a nozzle, the extrusion nozzle and guide means may be integrally moulded with a tubular portion to fit snugly over and be self-retaining on the nozzle of the extrusion device.

The wiping portion or portions is/are preferably resiliently flexible so that it or they can be flexed into intimate contact with the surface part or parts.

PRIOR ART

It is known to provide extrusion nozzles with guide means to assist in locating them in relation to surfaces onto or between which pasty material is to be extruded.

British Patent Specification No. 27,222 of 1909 describes a collapsible tube for liquid or semi-liquid material in which the delivery end of the tube or a cap mounted on the delivery end has a cavity with a septum which can be pierced to form a nozzle and a projection, mainly to one side of the cavity. The projection has a groove aligned with one side of the cavity, forming a channel for material expressed from the nozzle and ending in an inclined or bevelled face at the ends of which are ears or runners which have curved edges and project somewhat above the bevelled face. When the tube is inverted and applied to a surface to which the contents of the tube are to be applied, the runners bear upon the surface and hold the bevelled face slightly separated from the surface. When pressure is applied to the tube to force a stream of its contents through the outlet, the stream is deposited on the surface and spread by the bevelled face. The runners bearing on the surface limit the spreading of the stream and cause it to be deposited in a thin strip or ribbon of uniform width having sharply defined edges. The form of the runners enables the bevelled face to be raised or lowered relative to the surface by varying the inclination of the tube thus varying the thickness of the strip or ribbon.

In the embodiment described in the noted British Specification, the runners are quite small and make tangential contact with the surface on short lateral lines substantially in line with the point at which the stream of extruded material meets the surface. They have little confining effect on the stream and if excess material is extruded from the tube it will easily flow outside the runners onto the surface.

U.S. Pat. No. 3,133,300 describes the formation of a cap of a collapsible tube for use as a spreader for material extruded from the tube. The cap does not include a nozzle and is not used for extrusion. Material is extruded from the ordinary nozzle of the tube after removing the cap. The cap is then replaced for use as a spreader, the tube then serving as a handle. The cap has four blades of different forms to assist the user in forming ribbons of the extruded material of varied texture and width.

U.S. Pat. No. 3,594,089 describes an applicator nozzle for a flexible bottle containing a sealer fluid for joining the edges of sheets of floor covering material. The applicator nozzle has a starlike configuration adjacent its end with four perpendicularly disposed longitudinally extending fins, each of the same size and shape. In use, one fin, being downwardly directed, is inserted between the abutting edges of two sheets to be joined, so opening a gap between them. The two adjacent fins lie on the surfaces of the two sheets, controlling the depth to which the first fin penetrates into the gap. Sealer fluid is expressed from the bottle by squeezing it, and the bottle is moved backwardly (i.e. in the direction opposite to the flow of sealer fluid through the nozzle) along the junction between the abutting edges. The expressed sealer fluid thus enters the opened gap as well as flowing onto the margins of the two sheets adjacent to the gap. The gap progressively closes as the nozzle is moved along it. The extent to which the sealer fluid flows over the surface margins and the form and thickness of the ribbon or fillet of sealer so formed is determined only by the shape of the nozzle, the fluidity of the fluid sealer and the amount expressed from the bottle in relation to the speed at which it is moved. It is easy to see that if too much fluid is expressed it will flow away from the sheet margins over their surfaces or, if of greater viscosity, will be left as an upstanding bead over the closed gap, probably of irregular height if the squeezing and movement of the bottle have not been controlled uniformly.

In contrast to these prior disclosures, the invention provides apparatus with which an unskilled person can readily produce a neat and uniform fillet, the form of which is effectively defined by the fillet-forming portion which, in straddling the region, effectively provides a shaping aperture for the fillet.

DESCRIPTION OF THE DRAWING

Embodiments of the invention will now be illustrated by way of example in the accompanying drawings, in which.

DETAILED DESCRIPTION OF THE PREFERRED EMBODIMENTS

Figure 1:
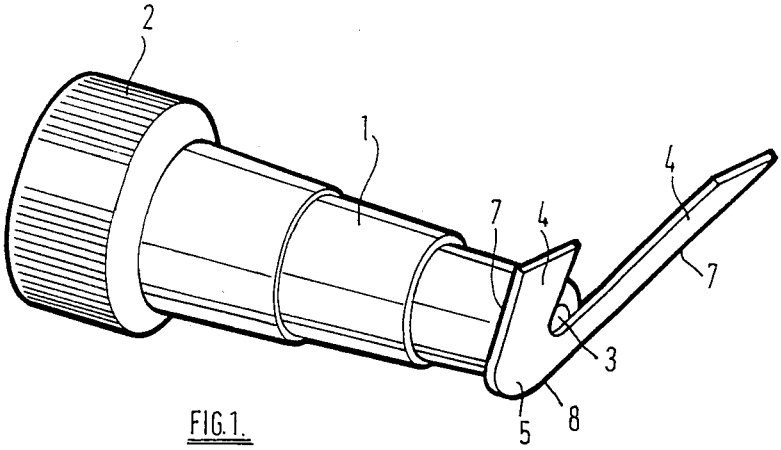
FIG. 1 is a perspective view of a nozzle and guide means for extruding a fillet between surfaces substantially at right angles.
Figure 2:
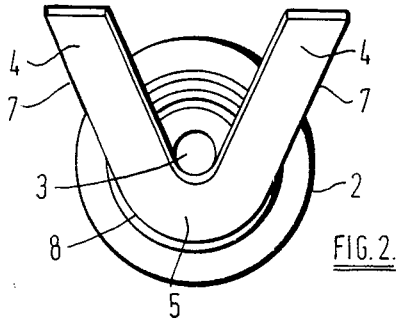
FIG. 2 is a front view of the nozzle and guide means shown in FIG. 1.
Figure 3:
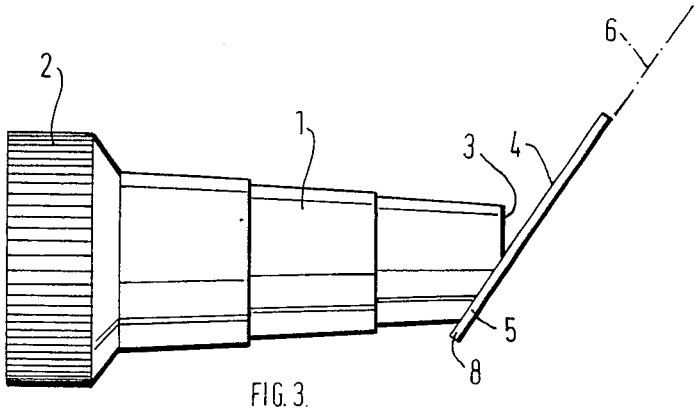
FIG. 3 is a side view of the nozzle and guide means shown in FIG. 1.

The nozzle and guide means illustrated in FIGS. 1 to 4 are moulded integrally from a resilient, flexible plastic material and is intended to be fitted to a collapsible tube or other extrusion device for pasty material. The nozzle 1 is a tapered tube having at its wider end a socket 2 to fit the extrusion device and its narrow end 3 forms the extrusion orifice. The guide means integrally moulded with the nozzle comprises a pair of wing-like wiping elements 4 extending from opposite sides of the narrow end 3 of the nozzle where they join a collar 5 extending around the periphery of the nozzle between them. The wiping elements extend forwardly and outwardly from the nozzle in a transverse plane 6 inclined at an angle of 55° to the axis of the nozzle 1. The outer edges 7 of the wiping elements 4 are inclined at an angle of 50° in the plane 6 and they merge substantially tangentially with the outer edge 8 of the collar 5 which serves as a forming edge for shaping extruded fillets as will be described.

Figure 4:
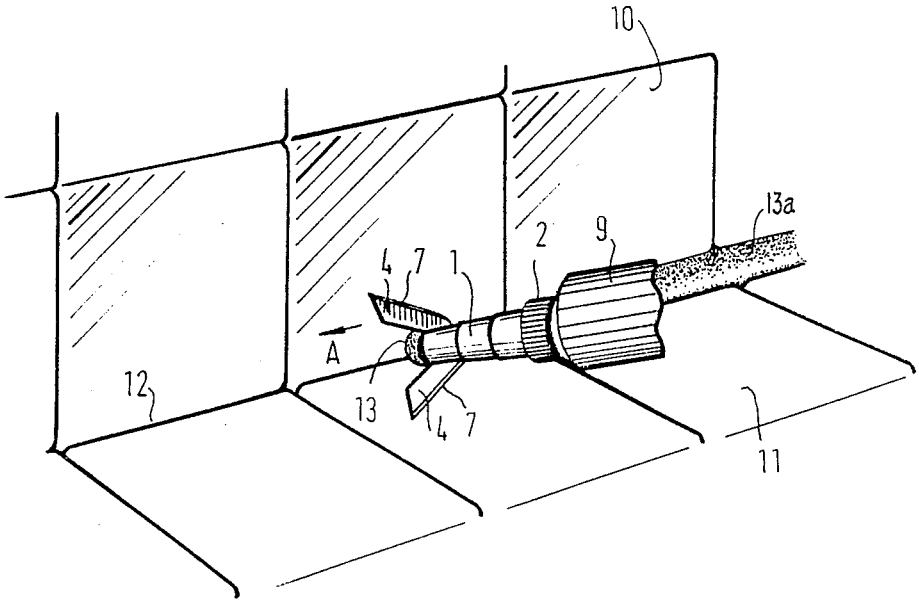
FIG. 4 is a diagrammatic perspective view showing parts of two intersecting surfaces and illustrating the use of the nozzle and guide means shown in FIGS. 1 to 3.

FIG. 4 shows the nozzle 1 mounted on the front of a collapsible tube 9 containing the pasty material, in use to form a fillet of the material between a tiled wall 10 and working surface 11, which meet at right angles at a junction 12. The nozzle 1 is directed towards the junction 12 at angles of about 45° to the junction and to the surfaces 10 and is 11 and positioned so that the outer wiping edges of the wiping elements of the guide means contact the respective surfaces 10 and 11. Slight pressure is applied as necessary to flex the wing-like elements 4 so that their edges 7 make line contact with the surfaces substantially throughout the length of the edges. Pasty material is squeezed from the tube to form a reservoir 13 of the material in the junction region immediately in front of the nozzle 1 and between the wing-like wiping elements 4. The nozzle is then moved forwardly, i.e., in the direction of the arrow A, along the junction whilst continuing to squeeze material from the tube 9 and maintaining the slight pressure against the surfaces 10 and 11. The extruded pasty material passes from the reservoir 13 through the shaping aperture defined between the surfaces by the forming edge 8 of the collar 5 straddling the junction between them. The material is thus pressed firmly into contact with the surfaces and is formed into a neat fillet 13*a* with a concave outer surface shaped by the forming edge 8. The line contact of the wiping edges 7 with the surfaces prevents significant escape of the pasty material from the reservoir under them, maintaining sharply-defined feather edges to the fillet 14 and keeping clean the adjacent parts of the surfaces 10 and 11.

The cross section of the fillet 14 can be regulated within limits by varying the angle between the nozzle axis and the junction 12.

With this simple apparatus an unskilled operator can produce a neat fillet with little practice. The fillet, being pressed into contact with both surfaces, will provide a good seal between them, as well as an attractive appearance for the junction.

FIGS. 5 to 17 illustrate a nozzle and guide means for performing a similar function to that of the embodiment illustrated in FIGS. 1 to 4 but which is used in a different manner.

As before, the nozzle and guide means illustrated are moulded integrally from a resilient, flexible plastic material and is intended to be fitted to a collapsible tube or other extrusion device for pasty material. The nozzle 14 is a tapered tube having at its wider end a socket 15 to fit the extrusion device, and its narrow end forms the extrusion orifice 16. The guide means integrally moulded with the nozzle comprises a pair of wing-like wiping elements 17 extending from opposite sides of the narrow end of the nozzle where they join a collar 18 extending around the periphery of the nozzle between them. The wing-like wiping elements 17 lie in a plane 19 inclined at an angle of 145° to the direction of extrusion of pasty material through the nozzle orifice, axially with respect to the nozzle 14, and extend rearwardly in the plane 19 from the nozzle. The collar 18 also lies in the plane 19 and is continuous with the wing-like wiping elements 17. The outer edges 20 of the wiping elements 17 are inclined at an angle of 50° in the plane 19 and they merge substantially tangentially with the outer edge 21 of the collar 18, serving as a forming edge for shaping extruded fillets.

Figure 5:
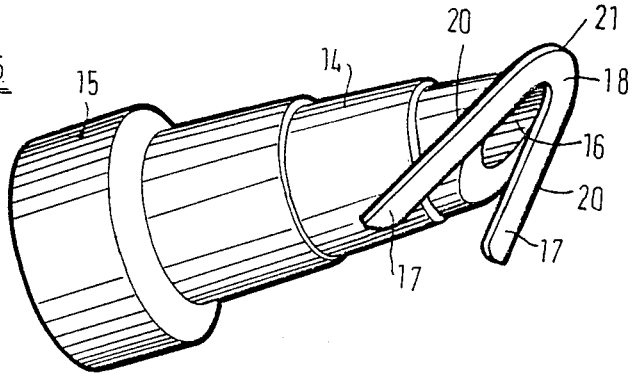
FIG. 5 is a perspective view of another nozzle and guide means for extruding a fillet between surfaces substantially at right angles.
Figure 6:
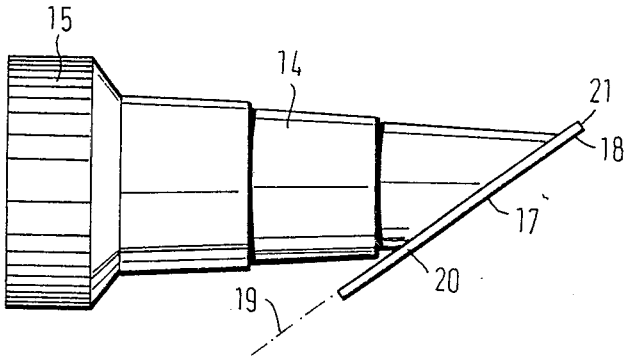
FIG. 6 is a side elevation of the nozzle and guide means shown in FIG. 5.
Figure 7:
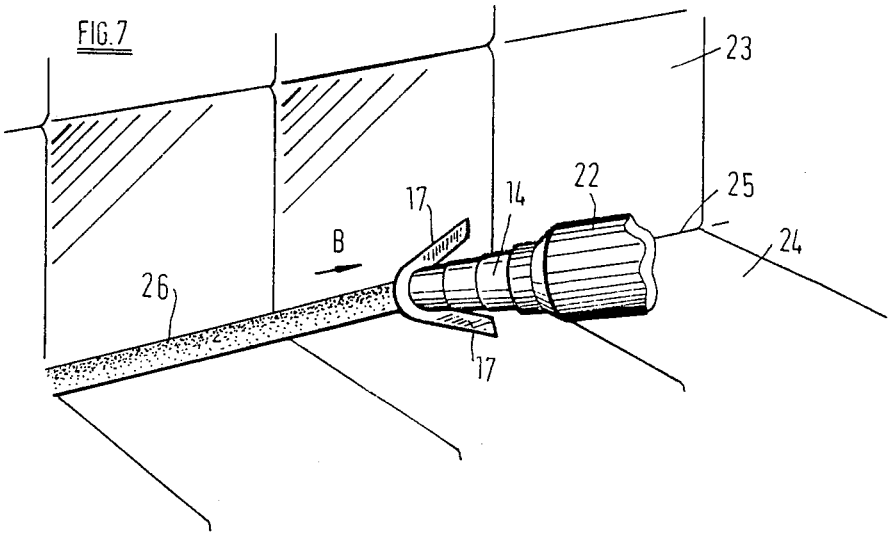
FIG. 7 is a diagrammatic perspective view showing parts of two intersecting or meeting surfaces and illustrating the use of the nozzle and guide means shown in FIGS. 5 and 6.

FIG. 7 shows the nozzle and guide means in use, mounted on a collapsible tube 22, to form a fillet between a tiled wall 23 and working surface 24, meeting at right angles in a junction 25. The nozzle is directed towards and positioned against the surfaces 23 and 24 similarly to the nozzle shown in FIGS. 1 to 4, with slight pressure applied to flex the wing-like wiping elements 17 into line contact with the respective surfaces. Pasty material is squeezed from the tube to form a reservoir of material (not shown) immediately in front of the nozzle orifice 16, and between the wiping elements 17. The nozzle is then moved backwardly, in the direction of arrow B, along the junction whilst maintaining its disposition relative to the surfaces 23 and 24 and continuing to squeeze material from the tube to keep a reservoir of material in front of the orifice 16. The extruded pasty material passes from the reservoir through the shaping aperture defined between the surfaces by the forming edge 21 of the collar 18 straddling the junction region between them. Thus it will be seen that the operation of the apparatus of FIGS. 5 to 7 is much the same as that described with reference to FIGS. 1 to 4 except that the apparatus is moved in the opposite direction along the junction region between the surfaces 23 and 24. The fillet produced is similar to that produced by the apparatus of FIGS. 1 to 4.

Because of the arrangement and angular disposition of the guide means in relation to the nozzle 14, the forming edge 21 of the collar 18 can be placed against or close to an obstruction in or near the junction 25, between the two surfaces 23, 24, and extrusion of the fillet can then commence, the nozzle being moved away from the obstruction along the junction. The resulting extruded fillet can thus extend right up to the obstruction if desired. Furthermore, where a junction between two surfaces is obstructed at two positions, it is possible to form a complete fillet along the junction between and right up to the two obstructions. In this case, the forming edge 21 of the guide means is first placed against or close to one obstruction and a fillet is formed in the manner described some distance along the junction towards the other obstruction. Then the apparatus is removed from the junction and its disposition relative to the junction is reversed so that it can be applied again with the forming edge 21 against or close to the other obstruction. A fillet is then extruded from the second obstruction along the junction until it meets the end of the first-formed fillet. The meeting ends of the two fillets can be blended together by use of the forming edge 21 to produce a continuous fillet between the two obstructions.

In both the embodiments described, the guide means, instead of being moulded integrally with the nozzle, may be a separate part with a socket to receive the end of a nozzle. The forming edge of the guide means may be shaped to produce a desired cross-section of fillet. It is usually preferable that the wiping edges are straight, to make good contact with flat surfaces, but they could be curved or profiled, particularly to match the contours of surfaces which are not flat. The rigidity of the guide means should be determined according to the viscosity of the pasty material to be extruded. The angles mentioned are appropriate for use in relation to surfaces substantially at right angles as described. For surfaces inclined at different angles the apparatus would be modified by appropriately changing the angles between the wing-like wiping elements and/or the inclination of their plane relative to the axis of the nozzle, so that the tube could be positioned conveniently between the surfaces and inclined so that the wiping edges make proper line contact with the surfaces.

The guide means, in contacting both surfaces, also guides the movement of the nozzle along the junction, reducing or eliminating movement perpendicular to the surfaces and thus maintaining the shaping aperture substantially constant. This helps to prevent the formation of transverse ridges in the extruded fillet.

Figure 8:
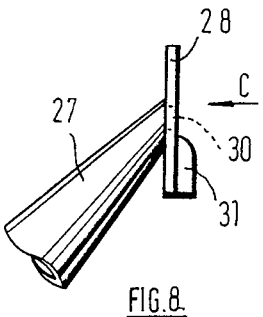
FIG. 8 is a side elevation of apparatus for grouting tiles.
Figure 9:
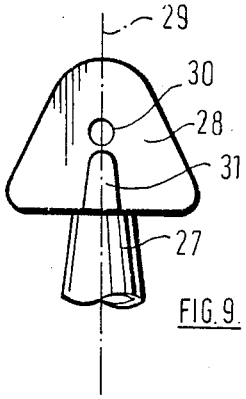
FIG. 9 shows the apparatus of FIG. 8 viewed in the direction of arrow C.

The apparatus shown in FIGS. 8 and 9, for grouting tiles, comprises a tapered tubular nozzle 27, having secured to its end a guide plate 28 in the shape of an isosceles triangle having its corners truncated and rounded. The plane of the guide plate 28 is inclined at 45° to the axis of the nozzle 27, which lies in the plane of symmetry 29 of the plate. The outlet orifice of the nozzle coincides with a central aperture 30 in the plate, and between the aperture and the base of the triangle the guide plate has a tapered projection 31, of width somewhat less than the gaps between tiles to be grouted, and convexly profiled in cross sections perpendicular to the plane 29, for forming pasty material extruded through the nozzle into the desired shape of fillet.

In use, the guide plate 28 is pressed flat against the tiles, with its plane of symmetry 29 lying centrally in a gap between tiles which is to be filled or grouted, and with the projection 31 aligned with one end of the gap. The pasty grouting material is extruded through the aperture 30 and, by virtue of the wiping contact between the side portions of the guide plate 28 and the adjacent margins of the tiles, is directed into and confined to the gap, and is excluded from the adjacent margins of the tile surfaces. The nozzle is moved forwardly along the gap whilst continuing to extrude the grouting material. The forming projection 31 then enters the gap and compresses and forms the extruded grouting material into the desired shape of fillet in the gap. A neat grouting fillet is obtained in a single operation. Little skill is required, the essentials being only to keep the plate 28 pressed firmly against the tile surfaces and to regulate the rate of extrusion of the grouting material so that the gap is adequately filled but the material is not forced out between the plate 28 and the tiles. If the latter should happen, the surplus material will be forced out beyond the rear corners of the plate 28 by its wiping action and so will be spaced from the fillet. Any such material can be removed easily from the surfaces without disturbing the fillet.

Figure 10:
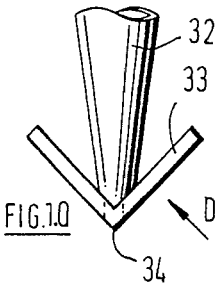
FIG. 10 is a side elevation of apparatus for filling gaps between doors or windows and their frames.
Figure 11:
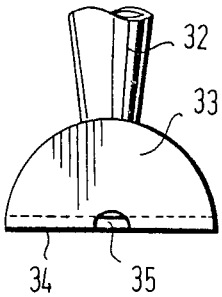
FIG. 11 shows the apparatus of FIG. 10 viewed in the direction of arrow D.

The apparatus shown in FIGS. 10 and 11, which is useful for forming a sealing fillet around a door or window frame, comprises a tapered nozzle 32 having symmetrically secured to its end an angular guide plate 33 comprising two semi-circular wiping portions joined in a right angle at their diametrical edges 34. A central aperture 35 in the plate coincides with the outlet orifice of the tubular nozzle 32.

In use, the nozzle 32 is positioned at 45° to the door or window and the adjacent frame part between which there is a gap to be filled, and the two semi-circular wiping portions of the plate 33 are pressed against the respective margins of the door or window and the frame surfaces adjacent to the gap. Pasty sealing material is extruded through the nozzle 32 and the aperture 35, and by virtue of the wiping contact between the semicircular portions of the plate 33 and the adjacent surfaces of the door or window and the frame it is directed into and confined to the gap. The nozzle 32 and plate 33 are moved along the frame so that the gap is filled with the extruded material, which is shaped by the right angled forming edge 34 of the plate so that the finished fillet is flush with the adjacent surfaces. It may be found advantageous to tilt the rear end of the nozzle 32 rearwardly with respect to the direction of movement so that there is a small clearance between the central part of the plate and the adjacent surfaces in which a reservoir of extruded material can be maintained and to force the rear corner of the plate firmly into the angle between the door or window and the frame to compress and shape the extruded material forming the fillet. The wiping contact of the rearward parts of the plate with the door or window and frame surfaces adjacent to the gap exclude the pasty material from those surfaces as the apparatus is moved along the gap.

Figure 12:
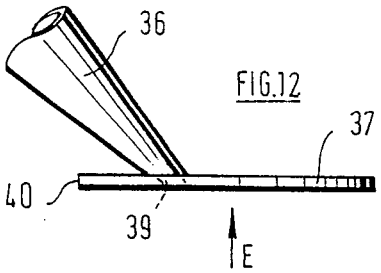
FIG. 12 is a side elevation of another apparatus for forming a fillet between surface parts.
Figure 13:
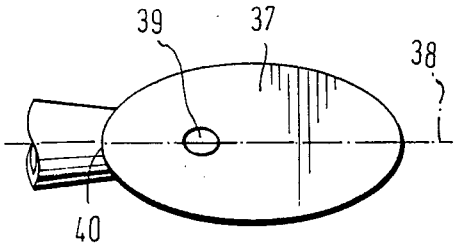
FIG. 13 shows the apparatus of FIG. 12 viewed in the direction of arrow E.

FIGS. 12 and 13 show apparatus particularly intended for forming a fillet in the angle between inclined surface parts which substantially meet or intersect. The apparatus comprises a tapered tubular nozzle 36 having secured to its end an elliptical plate 37, the axis of the nozzle being inclined at 45° to the plane of the plate and lying in the plane of the major axis 38 of the ellipse. The outlet orifice of the nozzle 36 coincides with an aperture 39 close to one end 40 of the plate.

In use, the nozzle 36 is positioned with its axis inclined to and directed somewhat along the region between the surface parts so that the end 40 of the plate 37 straddles the region, between portions of the edge of the plate which make line contact with the margins of the surface parts bordering the region. Thus the arc of the edge of the plate 36 between those portions forms with the respective surface parts a forming aperture for the extruded fillet to be produced. Pasty material is extruded to form a reservoir in front of the aperture 39 in the region between the surface parts and the nozzle is moved forwardly along the region whilst continuing to extrude the material. The wiping contact of the edge portions of the plate with the respective surface parts defines the boundaries of the region and prevents the extruded material from spreading beyond the boundaries, and the material is shaped into the desired fillet by the said arc at the end 40 of the plate which straddles the region. By varying the angle between the nozzle axis and the line of intersection of the surface parts, the shape of the fillet may be controlled as desired, and the rate of extrusion is regulated so as to maintain just an adequate reservoir of material in advance of the aperture 39. Because of the elliptical shape of the plate 37, the apparatus can be used to produce fillets of various shapes and thicknesses between surfaces inclined to each other at various different angles, and can readily be used to form fillets between intersecting curved surfaces. It may also be used for filling an irregular crack in a surface, producing a fillet substantially flush with adjacent margins of the surface.

Figure 14:
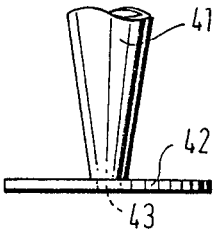
FIG. 14 is a side elevation of another form of apparatus for forming a fillet between surface parts.
Figure 15:
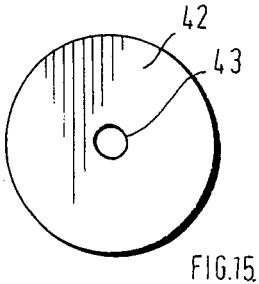
FIG. 15 is an end view of the apparatus shown in FIG. 14.

The apparatus of FIGS. 14 and 15 is similar to that shown in FIGS. 12 and 13 and is used for similar purposes and in a similar manner. It comprises a tapered tubular nozzle 41 having secured to its end a circular plate 42, the axis of the nozzle 41 and plate 42 coinciding. The plate has a central aperture 43 coinciding with the outlet orifice of the nozzle.

Figure 16:
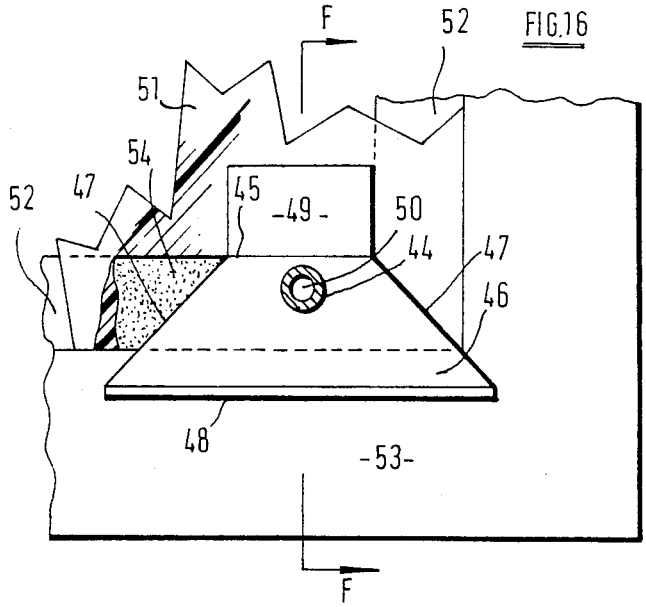
FIG. 16 is a fragmentary elevation showing parts of a window frame with apparatus in use for forming a fillet in the rebate of the frame.
Figure 17:
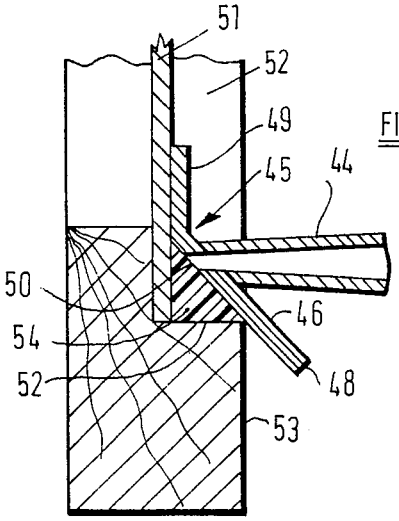
FIG. 17 is a section on the line F—F of FIG. 16

FIGS. 16 and 17 show apparatus in use for forming a fillet in the rebate of a window frame. The apparatus comprises a tapered tubular nozzle 44 having secured to its end an angular plate 45. The plate 45 has a portion 46 of trapezoidal shape, the side edges 47 of which are inclined at 45° to the base edge 48, from which extends an oblong rectangular wiping portion 49 inclined at 135° to the portion 46. The axis of the nozzle is perpendicular to the portion 49 and secured to the portion 46 close to its junction with the rectangular portion 49. An aperture 50 in the trapezoidal portion 46 coincides with the outlet orifice of the nozzle.

As shown, the nozzle is directed perpendicularly towards the window glass 51 and the rectangular portion 49 of the plate 45 is pressed against the glass, with the trapezoidal portion 46 making line contact with the edge of the rebate 52 of the frame and the adjacent frame surface part 53. As can be seen in FIG. 17, the trapezoidal portion 46 thus defines a triangular forming space between the glass and the rebate 52 into which putty or other pasty sealing material can be extruded through the aperture 50. The sealing material is confined to this space and excluded from the surface of the glass and the window frame surface part 53 by the contact of the plate 45 with the glass and the edge of the rebate. The nozzle is moved along the rebate 52 from one corner whilst continuously extruding the sealing material, which is thus formed by the trapezoidal portion 46 of the plate into the desired triangular fillet 54. When a side edge 47 of the plate meets the next corner of the rebate, as shown in FIG. 16, extrusion is ceased and the plate is removed from the window, turned through 90° and applied again at the corner end of the adjacent side part of the rebate. Extrusion is re-commenced and the extruded material will fill the space under the plate and join with the end of the fillet already formed. The nozzle is then moved up the side part of the rebate in the same manner leaving a neat mitred junction between the parts of the extruded fillet 54 along the bottom and side parts of the rebate. A complete fillet is formed around the frame by similarly moving the nozzle between the other corners of the frame.

It will be appreciated that the apparatus shown in FIGS. 16 and 17 can be used satisfactorily for window frames having various depths of rebate, so long as the trapezoidal portion of the plate is of sufficient length to make line contact with the edge of the surface part 53 defining the rebate 52.

Like the embodiments of FIGS. 1 to 17, each of the other embodiments described may conveniently be moulded integrally in plastics material. Preferably, the plastic material is of a flexible resilient nature so that the plates can be flexed somewhat as they are pressed against the respective surface parts so as to ensure firm wiping contact.

Instead of being secured to or moulded integrally with the nozzles as described, the plates may be secured to or formed with a collar or clip to fit over the nozzle of extrusion apparatus such as a collapsible tube, the nozzle then being cut to form an orifice coinciding with the aperture in the plate.

The invention is not restricted to the illustrative embodiments which have been described. Guide means having wiping and forming portions of various shapes may be produced to form fillets of various desired shapes in particular circumstances.

I claim:

1. A device for applying a fillet of pasty material to a region between two adjacent surface parts, said device comprising;

an extrusion nozzle which has a downstream end that includes an extrusion orifice therein, and a substantially planar, flexible, generally V-shaped guide means at said downstream end of said extrusion nozzle, said generally V-shaped guide means including first and second elongated wiping portions defining respective inner and outer edges and a collar portion defining an inner and an outer edge, the outer edge of said collar portion being curved and the inner edges of said elongated wiping portions, together with the inner edge of said collar portion, providing an open area therebetween, said guide means being located at said downstream end of said extrusion nozzle such that said extrusion orifice communicates with said open area; said first and second wiping portions of said generally V-shaped guide means being capable of flexibly contacting the respective two adjacent surface parts when said device is moved along the region therebetween to deposit a fillet of pasty material which has passed through said extrusion nozzle and out said extrusion orifice into said region, said collar portion shaping the outer surface of said fillet and said outer edges of said first and second elongated wiping portions preventing pasty material from depositing on said two adjacent surface parts.

2. The device as defined in claim 1, wherein the outer edges of said first and second elongated wiping portions are straight and merge with the outer edge of said collar portion in tangential fashion.

3. The device as defined in claim 2, wherein said outer edges of said first and second elongated wiping portions define an included angle of about 50°.

4. The device as defined in claim 1, wherein said extrusion nozzle defines a longitudinal axis therethrough and wherein the first and second elongated wiping portions of said generally V-shaped guide means extend forwardly and outwardly with respect to the downstream end of said extrusion nozzle and in a plane which is inclined at an angle of about 55° with respect to said longitudinal axis as it extends away from said downstream end.

5. The device as defined in claim 1, wherein said extrusion nozzle defines a longitudinal axis therethrough and wherein the first and second elongated wiping portions of said generally V-shaped guide means extend rearwardly and outwardly with respect to the downstream end of said extrusion nozzle and in a plane which is inclined at an angle of about 145° with respect to said longitudinal axis as it extends away from said downstream end.

6. The device as defined in claim 1, wherein said extrusion nozzle has an upstream end formed as a socket for connection to a tube of pasty material.

7. The device as defined in claim 1, wherein said generally V-shaped guide means is integral with the downstream end of said extrusion nozzle.

* * * * *